United States Patent [19]

Kim

[11] Patent Number: 4,528,474

[45] Date of Patent: Jul. 9, 1985

[54] METHOD AND APPARATUS FOR PRODUCING AN ELECTRON BEAM FROM A THERMIONIC CATHODE

[76] Inventor: Jason J. Kim, 13 Dianne Ct., Lafayette, Calif. 94549

[21] Appl. No.: 577,726

[22] Filed: Feb. 8, 1984

Related U.S. Application Data

[63] Continuation of Ser. No. 355,267, Mar. 5, 1982, abandoned.

[51] Int. Cl.[3] ..... H01J 1/14

[52] U.S. Cl. ..... 313/346 R; 313/310; 313/300; 313/308; 445/50; 445/51

[58] Field of Search ..... 313/449, 453, 460, 296, 313/299, 300, 308, 310, 346 R; 445/49, 50, 51

[56] References Cited

U.S. PATENT DOCUMENTS

| | | | |
|---|---|---|---|
| 3,384,776 | 5/1968 | Houston | 313/310 X |
| 3,534,455 | 10/1970 | Bondley | 313/346 R X |
| 3,656,020 | 4/1972 | Cronin | 313/346 R X |
| 3,697,321 | 10/1972 | Eckert et al. | 313/310 X |
| 4,288,717 | 9/1981 | Tanji et al. | 313/346 R X |
| 4,346,325 | 8/1982 | Nakasuji et al. | 313/346 R X |
| 4,468,586 | 8/1984 | Hohn | 313/346 R X |

FOREIGN PATENT DOCUMENTS

| | | | |
|---|---|---|---|
| 54-51461 | 4/1979 | Japan | 445/51 |
| 54-51462 | 4/1979 | Japan | 445/51 |

*Primary Examiner*—David K. Moore
*Assistant Examiner*—Vincent DeLuca
*Attorney, Agent, or Firm*—Flehr, Hohbach, Test, Albritton & Herbert

[57] ABSTRACT

Disclosed is a method and apparatus for producing a high electron beam current having a low energy spread at a high brightness of the beam and a uniform intensity distribution. The electron beam is extracted from an emission current which consists of used emission current and unused emission current. The used emission current has a uniform intensity distribution. The apparatus produces a negligibly small unused emission current by using both a frustum shaped cathode and a multi-electrode. The cathode comprises a thermoelectron emissive material having a low work function and one or more thin layers which cover the side surface of the cathode. A material of the outermost thin layer has a high work function. The multi-electrode consists of the cathode, a first grid electrode, a second grid electrode and an anode electrode. The used emission current is generated from the top surface of the cathode. The unused emission current that is generated from the side surface of the cathode is negligibly small. The top surface is immersed into a strong accelerating electric field. By adjusting the field at the top surface, an emission current density from the top surface can be varied in the range of one to several hundred times of the saturation current density at an operating temperature. Methods for manufacturing the cathode are provided.

39 Claims, 9 Drawing Figures

METHOD AND APPARATUS FOR PRODUCING AN ELECTRON BEAM FROM A THERMIONIC CATHODE

This is a continuation of application Ser. No. 355,267 filed Mar. 5, 1982, now abandoned.

BACKGROUND OF THE INVENTION

The present invention generally relates to an electron beam apparatus which is demountable and a method for producing a high electron beam current which has a low energy spread at high brightness and a uniform intensity distribution.

Many different demountable electron beam apparatus have been developed in the prior art for the purpose of producing an electron beam having a low energy spread at high brightness by using a sharp tip of thermionic cathode such as lanthanum hexaboride ($LaB_6$) or using a sharp tip of field emission cathode. These cathodes are primarily used for producing a low beam current (typically less than several nanoamperes). A field emission cathode has difficulties for producing a high beam current. A lanthanum hexaboride cathode with a sharp tip produces an electron beam with a non-uniform intensity distribution. In electron beam apparatus wherein a shaped beam is used in microfabrication of large scale integrated circuit patterns as described in U.S. Pat. No. 4,213,053, U.S. Pat. No. 4,243,866 and U.S. Pat. No. 4,163,155, a high beam current having a low energy spread in a focused shaped beam on a target is essential for fast writing time of the circuit patterns (typically more than several microamperes). Other desirable features for such a focussed shaped beam are a high current density, a uniform distribution of current density and a sharp beam edge. These features may be attained by illuminating a spot shaping aperture with an electron beam which has a low energy spread at high brightness and a uniform intensity distribution.

It can be clearly understood how the high brightness, the low energy spread and the uniform intensity distribution are related to the high current density, the uniform distribution of current density and the sharp beam edge of a focussed shaped beam with the following relation:

$$J \approx J_o(eV/\Delta E_t)\sin^{2\alpha}$$

This relation gives the current density J attainable in a focussed shaped beam. The saturation emission current density is $J_o$, the beam voltage is V, the electronic charge is e, the absolute temperature is T, the half beam convergence angle is $\alpha$, and the transverse energy spread is $\Delta E_t$. If $\Delta E_t$ is equal to kT (k is Boltzmann constant), the above relation becomes Langmuir's relation. The brightness ($\beta$) of the beam is given by $\beta = J_o/\pi(eV/\Delta E_t)$. The higher the saturation emission current density $J_o$ and the lower the transverse energy spread $\Delta E_t$ is, the higher the brightness ($\beta$) becomes for a given value of beam voltage V. In turn, the higher brightness provides the higher current density J for a given value of beam convergence angle $\alpha$. It is a well-established fact that, in a high current electron beam apparatus, the energy spread in the beam is substantially higher (as high as 10 eV) than the thermal energy spread (less than 0.5 eV). The increase in the energy spread is attributed to the electronelectron interaction. The increased energy spread causes not only the blurring of the beam edge in a focussed shaped beam but also the decrease in the attainable current density J. Furthermore, in an electron beam apparatus which uses a sharp cathode tip or tungsten hairpin cathode, the uniform current density is obtained by only accepting spatially and angularly central portion of the emitted electrons from the cathodes. Such a large unused emission current is very detrimental since the electrons in the unused emission current interact not only with themselves but also with those in the used emission current, thus broadening the energy spread in the used beam. The ratio of a beam current in a focussed spot to a total emission current, which is known as the current efficiency $E_c$ is typically less than 0.2% for 5% uniformity of the current density for an electron beam apparatus using a sharp cathode tip or tungsten hairpin cathode.

Therefore, an electron beam apparatus for producing an electron beam with a high current efficiency ($E_c$), which has a low energy spread at high brightness and a uniform intensity distribution, is essential to attain a high throughput and high resolution in an electron beam lithography machine.

SUMMARY OF THE INVENTION

It is, therefore, an object of the present invention to provide a method and apparatus for producing an electron beam with a high current efficiency which has a low energy spread at high brightness and a uniform intensity distribution.

It is another object of the present invention to provide a method and apparatus for producing a high emission current density for a used emission current and a low emission current density for a unused emission current.

It is another object of the present invention to provide a method and apparatus for producing the high emission current density which has a uniform angular emission pattern and a uniform intensity distribution so as to produce the used emission current having a uniform intensity distribution.

It is another object of the present invention to provide a method for manufacturing a thermionic cathode which has a high emission current density for a used emission current and has a low emission current density for a unused emission current.

It is another object of the present invention to provide a method and apparatus for confining an electron emission area on a thermionic cathode from which used beam electrons emit and for limiting the area on the cathode from which unused beam electrons emit.

It is yet another object of the present invention to provide a method and apparatus for applying an accelerating electric field of adjustable strength at the area on the cathode from which used beam electrons emit so as to minimize the energy spread in the beam.

It is further another object of the present invention to provide a method and apparatus for controlling the emission current density for used emission current in the range of one to several hundred times of the saturation emission current density.

The present invention provides an electron beam which has a low energy spread at high brightness and a uniform intensity distribution for an electron beam apparatus which needs a high beam current in a shaped beam focussed on a target. A low energy spread in the beam enables a focussed shaped beam not only to attain the current density J close to the value indicated by Langmuir's relation but also to have a sharp beam edge because of a small axial chromatic aberration in projection optics.

The electron beam apparatus in accordance with the present invention provides both means for confining the area from which used beam electrons emit and for restricting the area from which unused beam electrons emit. The apparatus, also, provides means for immersing the above-mentioned confined cathode area in an accelerating electric field of adjustable strength. The used beam electrons emit primarily from the top surface of a frustum shaped cathode which is made from a thermoelectron emissive material having a low work function, preferably a single crystal lanthanum hexaboride. Therefore, an intensity distribution and angular emission pattern from the top surface of this cathode are very uniform. The side surface of the cathode is coated with one or more thin layers, having a high work function, a high melting point and a low vapor pressure at an operating temperature. This material should hardly react chemically with the thermoelectron emissive material at an operating temperature. Since the saturation emission current density from the thin layer is negligibly small compared to that from the top surface, the unused beam electrons emitted from the side surface can be made negligibly small by restricting the emission area on the side surface for a cathode having a very large side surface area. Although, the first grid electrode is primarily used to suppress an electron emission from cathode heaters and electrical conductors carrying electric current for heating the cathode, it can be also used to restrict the emission from the side surface of the cathode down below the front surface of the first grid electrode. The height of the top surface of the cathode from the front surface of the first grid electrode determines the degree to which the top surface is immersed in the accelerating field.

In accordance with a more particular aspect of the invention, the apparatus further includes means for adjusting the operating temperature on the top surface and to thereby provide the capability of both varying the saturation emission current density and ensuring that the thin-layer material does not chemically react with the thermoelectron emissive material.

In accordance with another more specific aspect of the invention, the apparatus further includes means to provide the adjustable accelerating electric field at the top surface by varying a positive potential (with respect to the cathode) on a second grid electrode. The strength of the field at the top surface can be varied from $10^3$ V/cm to $10^5$ V/cm for thermionic emission; from $10^5$ V/cm to $10^6$ V/cm for Schottky emission; and from $10^6$ V/cm to $10^7$ V/cm for thermalfield emission. This is done not only to control the emission current density in the range of one to several hundred times of the saturation emission current density, but also to minimize the electron-electron interaction.

In accordance with further specific aspect of the invention, the apparatus includes anode electrode means to provide a ground potential to the cathode which determines the beam voltage. The anode electrode means further include spot shaping aperture means, preferably square aperture means, electrostatic beam blanking means, and electromagnetic deflection means.

In order to line up the cathode means, the first grid electrode means, the second grid electrode means and the anode electrode means along a straight line passing the centers of the above listed electrode means, means are provided to move the cathode and the second grid electrode means laterally with respect to the first grid electrode and then to move the assembled unit of these three electrode means laterally with respect to the anode electrode means.

In accordance with a particularly significant object of the present invention, the apparatus further provides means for ensuring that the thin layer of material with a high work function does not chemically react with the thermoelectron emissive material of low work function by interposing any material which does not chemically react with both materials.

In accordance with another more significant object of the present invention, a method for manufacturing a thermionic cathode with any heating means, whose saturation emission current density from the side surface of the cathode is negligibly small compared with that from the top surface of the cathode of any shape, is provided.

The foregoing and other objects, features and advantages of the invention will be apparent from the specific description of the preferred embodiments of the invention as illustrated in the accompanying drawings.

DETAILED DESCRIPTION OF THE PREFERRED EMBODIMENT

The electron beam apparatus of this invention will be described in general with reference to FIG. 1, while unique features and advantages of the invention will be described with reference to FIG. 2–FIG. 9.

Figure 1:
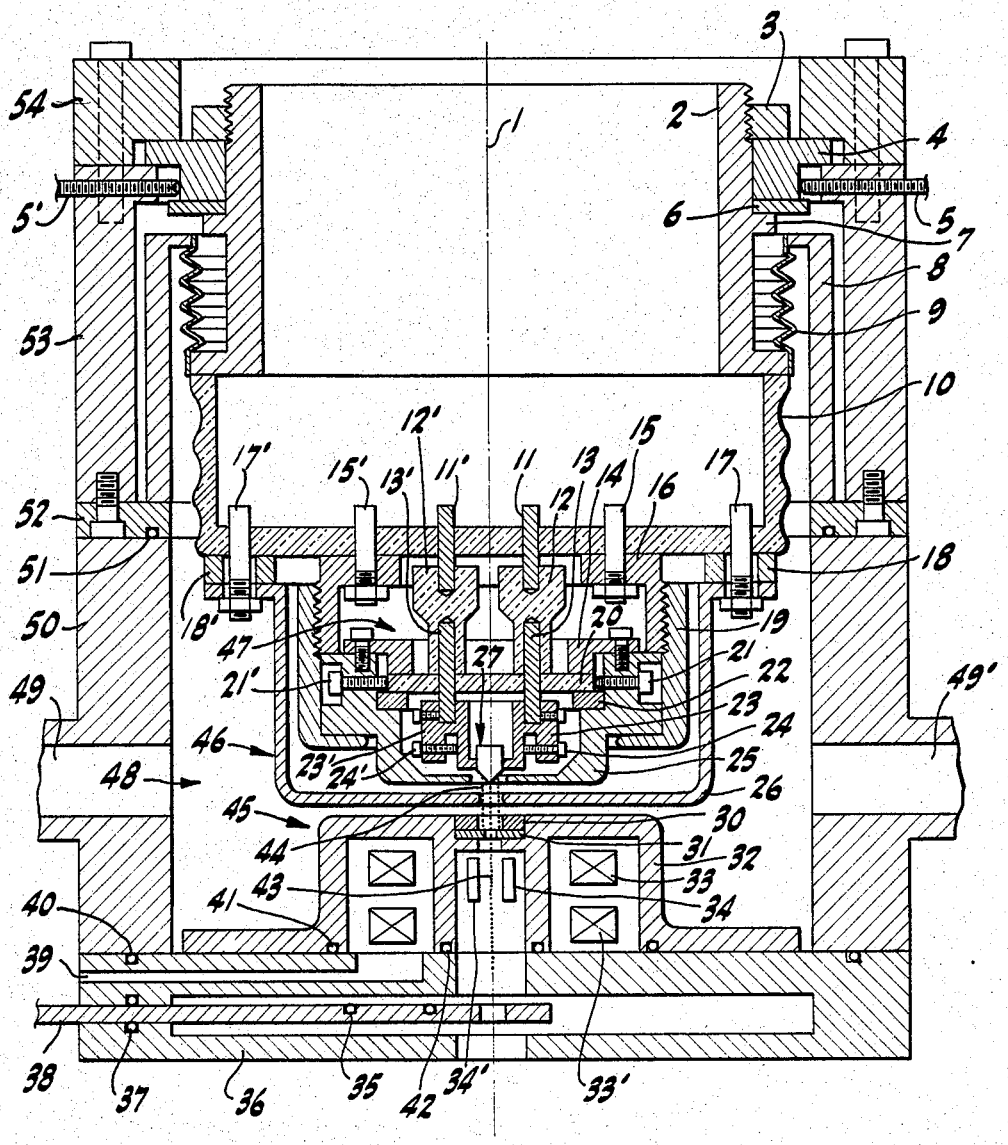
FIG. 1 is an enlarged cross-sectional view of an electron beam apparatus constructed in accordance with the invention.
Figure 3:
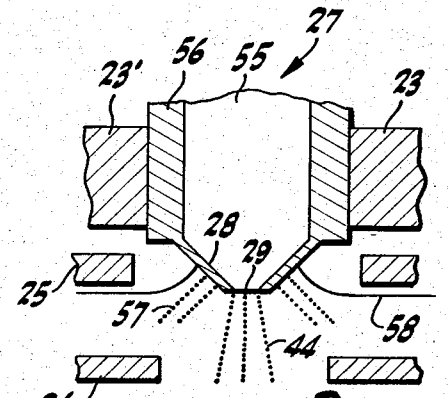
FIG. 3 is an enlarged fragmentary cross-sectional view showing an emitter assembly unit with a frustum shaped cathode having a large cone angle in accordance with the invention.

Referring now to FIG. 1, the emission current 44 from the cathode 27 comprises electrons emitted from the top surface 29 of the cathode (the top surface 29 is shown in FIG. 3). These electrons 44 are directed toward the anode electrode 32 along the axis 1 which is a straight line passing through the centers of the top surface 29, and circular holes of the first grid electrode 25, the second grid electrode 26, and the anode electrode 32. The cathode assembly unit 47 consists of the heating conductors 23, 23', the clamping screws 24, 24', the cathode base 20, and the tungsten leadthroughs 13, 13'. The cathode 27 is held under pressure from two heating conductors 23, 23'. The heating conductors are tensioned by the clamping screws 24, 24' to minimize the effects of differential thermal expansion at the jaws of the heating conductors. The tungsten leadthroughs 13, 13' are brazed into the cathode base 20, which is made from alumina. The cathode assembly unit 47 is mounted on the tungsten leadthroughs 11, 11' via the push-fit pins 12, 12'. The spacers 22 are inserted between the cathode base 20 and the first grid electrode 25 in order to adjust the height of the top surface 29 from the front surface of the first grid electrode 25. The lateral position of the cathode 27 with respect to the axis 1 is adjusted by using four screws 21, 21' (two other screws are not shown here). The spacers 18, 18' are inserted between the top surface of the high voltage insulator 10 and the second grid electrode 26 in order to adjust the spacing between the first grid electrode 25 and the second grid electrode 26, and to thereby provide the capability of obtaining electric field up to 100 kV/cm in the spacing between two electrodes 25, 26. The second grid electrode 26 is laterally positioned with respect to the axis 1 before being screwed down on the spacers 18, 18'.

Negative voltage (with respect to the cathode 27) applied on the first grid electrode 25 suppresses an electron emission from the heating conductors 23, 23' of the cathode 27 while positive voltage (with respect to the cathode 27) applied on the second grid electrode 26 controls the electric field at the top surface 29 and thus determines the emission current 44 for a given operating temperature at the top surface 29. The anode electrode 32 provides a ground potential with respect to the cathode 27. Thus a voltage applied on the cathode (which is called beam voltage) determines the energy of the electron beam 43. The beam voltage is adjustable between few kilovolts and several ten kilovolts. The electron beam 43 diverges from the second grid electrode 26 from a virtual source whose position depends slightly on the ratio between the second grid voltage and the beam voltage and whose size is determined primarily on the size of the top surface 29.

The anode assembly unit 45 consists of the anode electrode 32, a ring 30, a spot shaping aperture 31, preferably a square aperture, two sets of deflection yokes 33, 33', and an electrostatic beam blanker 34, 34'. Then ring 30 holds down the spot shaping aperture 31. The deflection yokes 33, 33' allows the electron beam 43 to deflect laterally and to thereby provide the capability of directing the electron beam 43 to other electron beam apparatus (not shown here) using the apparatus of this invention. A voltage applied between a pair of plates 34, 34' deflects the electron beam 43 away from the axis 1, which is done always before an isolation valve 38 is actuated to translate the O-ring 35 to the position underneath the center bore of the isolation valve housing 36 in order to provide vacuum seal to the gun vacuum chamber 48. Electrical wirings for the deflection yokes 33, 33' and the electrostatic beam blanker 34, 34' are provided through the cavity 39 of the isolation valve housing 36.

The emitter assembly unit 46, comprising the cathode assembly unit 47, the first grid electrode means 25, 19, 16, and the second grid electrode means 26, 18, 18', is clamped down on the top surface of the high voltage insulator 10 which is made from porcelain. The high voltage insulator 10 is brazed to the insulator support tube 2 made from stainless steel. This metal bellow 6 is welded to the insulator support tube 2 and the bellow support tube 8. The bellow support tube 8 is welded to the ring 52. The spacers 6 are inserted between the shoulder 7 of the insulator support tube 2 and the X-Y adjuster 4 in order to provide the capability of adjusting the spacing between the emitter assembly unit 46 and the anode assembly unit 45. The X-Y adjuster 4 provides the lateral movement of the emitter assembly unit 46 with respect to the anode assembly unit 45 by using four screws 5, 5' (two other screws are not shown here) which are driven by four micrometers (which are not shown here). The nut 3 screws down the X-Y adjuster 4.

The gun housing comprising three cylinders 50, 53, 54 and one ring 52, the anode assembly unit 45 and the isolation valve housing 36 are assembled together by using O-rings 37, 40, 41, 42, 51 for vacuum seal and screws (some of screws are shown here without numbering). Two pump ports 49, 49' are provided to maintain vacuum in the gun chamber 48.

Figure 4:
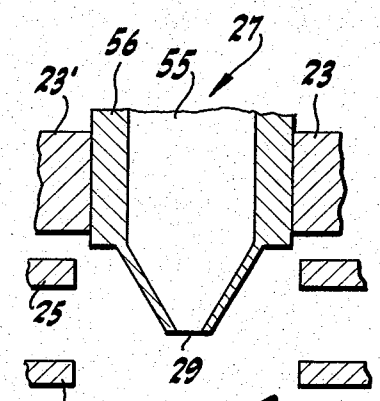
FIG. 4 is an enlarged fragmentary cross-sectional view showing an emitter assembly unit with a frustum shaped cathode having a small cone angle in accordance with the invention.

Now important aspects of the invention are discussed in great detail below with references to FIG. 2–FIG. 9 Referring to FIG. 2, the cathode 27 of the invention comprises two different materials; a shaped (preferably a frustum of a cone) thermoelectron emissive material 55 having a low work function (preferably lanthanum hexaboride) and a thin layer 56 of material which not only has a work function, a low vapor pressure and a high melting point, but also hardly reacts chemically with the thermoelectron emissive material at an operating temperature. Parameters describing the cathode which determine optical properties of the apparatus shown in FIG. 1 are the diameter $D_c$ of the top surface 29, and the cone angle $\theta$. The diameter $D_c$ determines the size of electron source and the cone angle $\theta$ influences the strength of electric field at the top surface 29 for given values of the spacing between the top surface 29 and the second grid electrode 26, and the voltage applied on the second grid electrode 26. Other geometrical parameters, i.e., the thickness $t_s$ of the thin layer 56 and the diameter $D_b$ of the cone base have little influence on the optical properties. An emission current density from thermoelectron emissive material is proportional to $e-\phi/kT$ where $\phi$ is the work function in the unit of electron-volt. Therefore, a small difference in the work function $\phi$ makes an enormous difference in emission current density. For example, the ratio of emission current density of lanthanum hexaboride ($\phi=2.52$ eV) to that of rhenium ($\phi=4.87$ eV) is about $4.9\times10^6$ at operating temperature of 1773° K. For a cathode having a very large side surface area, the area of the top surface 29 can become a small fraction of the total surface area of the cathode 27. Therefore, the total beam electrons emitted from the side surface 28 can be a major portion of a total emission current when a cathode is immersed in a strong accelerating electric field, unless means are provided to limit an electron emission area on the side surface 28. In this case, it is not sufficient to use a cathode 27 with a low work function whose side surface 28 is coated with a material having a high work function in order to obtain an emission current with a low energy spread having a uniform intensity distribution. It is necessary to have means for limiting an area on the side surface 28 from which the unused beam electrons emit. The means for limiting an electron emission area on the side surface 28 are provided by an equipotential line 58 (with respect to the cathode potential) drawn in FIG. 3. The location of the equipotential line 58, especially on the surface side 28 depends on both voltages applies on the first grid electrode 25 and the second grid electrode 26 for a given height of the top surface 29 from the front side of the first grid electrode 25. The equipotential line 58 determines approximately the boundary line on the side surface 28 where electrons emitted from the side surface 28 behind the boundary are suppressed. The beam electrons 57 emitted from the side surface 28 in front of the boundary are negligibly small. Thus the increase in the energy spread of the beam 44 caused by the beam electrons 57 is negligible. Furthermore, most of the beam electrons 57 are intercepted by the second grid electrode 26. Consequently, electron source size viewed from the outside of the second grid electrode 26 is primarily determined by the diameter $D_c$ of the top surface 29. As the top surface field increases, the work function $\phi$ decreases. The decrease in the work function causes the increase in the emission current density by $e^{0.44\sqrt{E/T}}$ (E is in the unit of volt/m). For example, the increase in the emission current density is ten times at $E=6.7\times10^5$ V/cm and $T=1573°$ K. Further increase in the top surface field causes field emission of electrons (typically $E>10^7$ V/cm and $D_c<5$ μm), thereby increasing the emission current density by more than 100 times. The top surface field depends primary on the height of the top surface 29 from the front surface of the first grid electrode 25. Since the cathode is held just beneath the cone base by the heating conductors, the smaller the cone angle $\theta$ is, the higher the height is for a given value of the cone base $D_b$. Therefore, the smaller the cone angle is, the more the top surface is immersed in the accelerating field. On the other hand, the smaller the cone angle is, the less the heat conducts to the top surface 29. Consequently, the arrangement of the cathode 27 with a large cone angle $\theta=90°$ as shown in FIG. 3 is preferred for thermoemission mode while that of the cathode 27 with a small cone angle ($\theta<60°$) as shown in FIG. 4 is preferred for Shottky emission for thermalfield emission mode. The diameter $D_c$ to be used is typically in the range from less than 5 μm to more than 100 μm; the cone angle is in the range between a few degree and 90 degree the base diameter $D_b$ is typically 250 μm–500 μm; the thickness $t_s$ is typically 0.1 μm–2 μm above the cone base, but it is more than 10 μm below the cone base. A thick layer below the cone base functions as contact pads both for heating wires to be welded or for heating conductors to be clamped.

Figure 5:
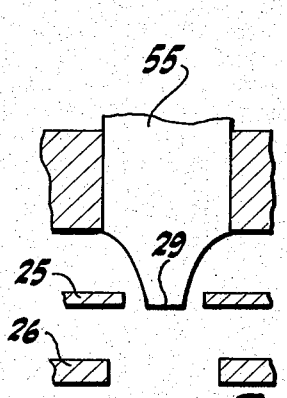
FIG. 5 is an enlarged fragmentary cross-sectional view showing an emitter assembly unit using a hyperbolic shaped cathode without coating of the thin layer in accordance with the invention.

Now referring to FIG. 5, the cathode 55 is a bare thermoelectron emissive material (i.e., without the coating of the thin layer 56). The top surface 29 is placed as close as possible to the same height as the front surface of the first electrode 25 so as to limit the beam electrons emitted from a cathode surface to the top surface 29. The preferred cathode shape is hyperbolic with a long neck from the cone base to the top surface 29. The first grid electrode 25 is very thin and is made from rhenium or coated with rhenium. Here, the thin electrode structure made from rhenium or coated with rhenium is necessary because the electrode 25 is located nearby to the top surface 29. Also, it requires precision assembly techniques to control the height and lateral position of the top surface 29 with respect to the front surface of the first grid electrode 25. The maximum field at the top surface 29 that can be maintained reliably is about $50\times10^3$ V/cm. Therefore, it may be difficult to use the cathode in the configuration as shown in FIG. 5 in Schottky emission or thermalfield emission mode. Nonetheless, beam electrons emitted from the top surface 29 are accelerated away toward the second grid electrode 26 because of a strong field with the result of a low energy spread in the beam.

The thermoelectron emissive material 55 which may be used in accordance with the present invention includes alkali earth metal boride such as barium hexaboride ($BaB_6$), calcium hexaboride ($CaB_6$), rare-earth metal boride such as lanthanum hexaboride ($LaB_6$), neodymium hexaboride ($NdB_6$), doped rare-earth metal boride such as lanthanum-praseodymium hexaboride ($La_{0.3}Pr_{0.7}B_6$) lanthanum-neodymium hexaboride ($La_{0.3}Nd_{0.7}B_6$), and combination of rare earth metal borides such as compounds of praseodymium (Pr) or neodymium hexaboride ($NdB_6$) with 10%–30% additions of lanthanum hexaboride ($LaB_6$). Of these compounds $LaB_6$ is most preferred since a single crystal $LaB_6$ is readily available on a commercial market. Material 56 which is used for coating the thermoelectron emissive material can be any material which has a high work function, and hardly reacts chemically with the thermoelectron emissive material 55 and a low vapor pressure at an operating temperature such as rhenium (Re), carbon (C) and tantalum carbide (TaC). Of these materials, rhenium (Re) is most preferred, since it has the highest work function. The cathode 27 using a thin layer of rhenium has another advantage, that is, the cathode 27 can be welded on heating wires, while the cathode 27 using a thin layer of carbon or tantalum carbide can use only mechanical contact with heating conductors. Therefore, if spot welding of the cathode 27 coated with carbon or tantalum carbide to heating wires is desired, this cathode requires an additional coating with a material which can be welded to heating wires. Other requirements for this material are a high work function, a high melting point, a low vapor pressure and no chemical reaction with tantalum carbide or carbon as well as the thermoelectron emissive material 55. Again rhenium is the most preferred material for the additional coating.

Figure 2:
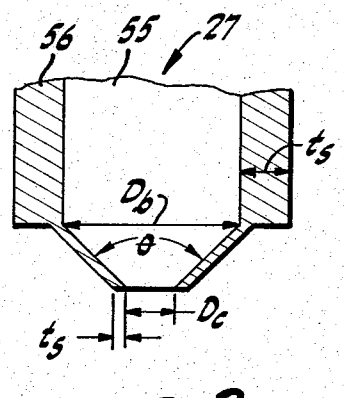
FIG. 2 is an enlarged fragmentary cross-sectional view showing a thermionic cathode made in accordance with the method of the invention.

The shaped cathode structure 27 coated with the single layer 56 as shown in FIG. 2 may be manufactured in any known method. The methods for manufacturing the cathode structure 27 as shown in FIG. 2 are illustrated in the following examples:

EXAMPLE 1 ($LaB_6$—Re)

Step 1. Single crystal $LaB_6$ rods, preferably <100> orientation are prepared to be of a square cross section, approximately 250 μm square and about 2 mm long. These rods are cut from arc-melted boules of materials or crystallites produced in the aluminum-flux process for $LaB_6$.

Figure 6:
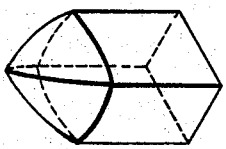
FIG. 6 is a schematic showing a cone shaped cathode before fabricating the top surface of the cathode.

Step 2. One end of the rod is shaped into the cone by electrochemical etching or mechanical grinding as shown in FIG. 6. Electrochemical etching is preferred since the cone angle $\theta$ and the profile of the cone surface can be easily controlled by adjustment of a voltage (AC or DC) on the cell. Typical etchants are a solution of 20% phosphoric acid, 15% glycerol and 65% water, and 15% HCl and 85% water.

Step 3. The rod is coated with rhenium in an electron base evaporator (a typical vacuum apparatus for coating thin films in semiconductor industry). The rod is placed underneath a rhenium target with a cone shaped tip positioned in the line of sight with the rhenium target. The rhenium target is heated above the boiling point by intense electron beam bombardment on the rhenium target. The thickness of a desired coating (0.1 μm–2 μm) is obtained by adjusting the electron beam current.

Step 4. A rhenium coated cathode undergoes a special heat treatment. "The procedure for the heat treatment is as follows:

The coated cathode is placed on a graphite disk. Its cone shaped tip is irradiated with an intense electron beam in an electron beam evaporator. The cathode is held by two graphite blocks under pressure applied by molybdenum clamps.

The cathode tip is heated to a temperature about from 100° C. to 700° C. higher than a cathode operating temperature by intense electron beam bombardment for approximately a half hour to one hour".

The heat treatment, for this particular case, is to speed up any possible chemical reaction at the interface between two materials and any possible diffusion of the coating material into the thermoelectron emissive material at a temperature higher than normal cathode operating temperature so that the chemical stability of the cathode 27 can be achieved at operating temperature.

Figure 7:
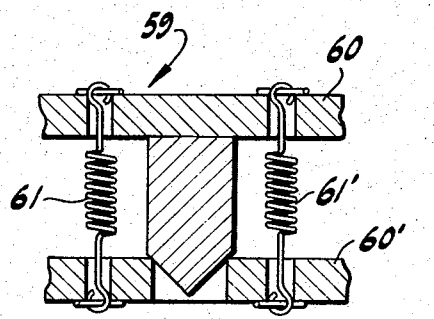
FIG. 7 is an enlarged fragmentary cross-sectional view of a cathode mounted in a fixture before coating only four sides of a cathode bar.
Figure 8:
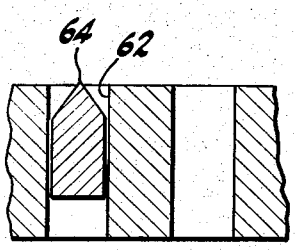
FIG. 8 is an enlarged fragmentary cross-sectional view of a cathode mounted in a fixture before lapping and polishing the cathode tip.
Figure 9:
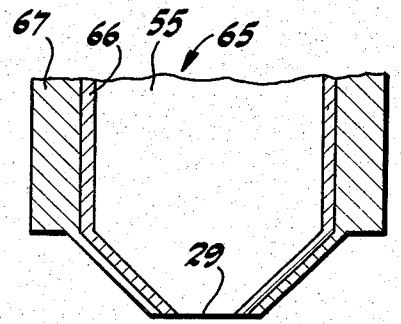
FIG. 9 is an enlarged fragmentary cross-sectional view of another embodiment of a thermionic cathode made in accordance with the method of the invention.

Step. 5. Referring to FIG. 7, the rod is placed in a fixture 59 in order to mask the cone shape tip from an additional coating of rhenium to be processed in the next step. The rod is placed between two plates 60, 60' under slight pressure applied by two springs 61, 61'. The plate 60' has circular holes drilled through to accommodate the cone shape tips. Two springs 61, 61' are located on the diagonal line of the square cross-section of the rod. Two plates 60, 60' and two springs, 61, 61', can be made from any material which is compatible with high vacuum.

Step. 6. The fixture 59 is placed on a disk which can be rotated along its own axis in the electron beam evaporator. The disk is arranged such that its axis is vertical with respect to the line of sight to the rhenium target. Thus, evaporated rhenium from the target by intense electron beam bombardment coats each side surface of the square $LaB_6$ rod while the disk is rotating, thereby attaining a uniform coating. Desired thickness is, typically, more than 10 μm to provide contact pads to heating wires or heating conductors.

Step. 7. Now referring to FIG. 8, the cathode is inserted into a square hole 62 drilled through a block of aluminum and potted with a melted wax (the melting temperature is less than 100° C.). The tip 64 of the cathode 27 is lapped and then polished using diamond lapping compounds of different size of diamond particles on teflon cloth (i.e., for lapping the size of diamond particles is larger than 3 μm and for polishing the size is less than 1 μm) until a desired diameter $D_c$ of the top surface 29 is obtained. The block of aluminum is heated to melt the potting wax so as to take out the frustum shaped cathode. The cathode is cleaned with a solvent which dissolves the wax.

Now the cathode is ready to use.

EXAMPLE 2 ($LaB_6$—C)

Step 1. The same as Step 1 in example 1.

Step 2. The same as Step 2 in example 2.

Step 3. Immediately after a cone shaped tip is fabricated, the rod is coated with carbon in a carbon evaporator (a typical vacuum apparatus for making carbon film to support a specimen in transmission electron microscopes). The rod is placed underneath a carbon source with the cone shaped tip of the cathode in the line of sight with a carbon source. The carbon source is a small cylinder rod with a sharp tip at one end (approximately, the cylinder diameter being 1 mm and the length 5 mm). The carbon source is held under pressure by two other carbon rods which are arranged in a vacuum bell jar, one fixed and the other sliding in a silica tube and lightly sprung so as to force the sharp point of the carbon source against the fixed carbon rod. By passing a heavy current through the carbon source, resistance heating at the point of contact with the sharp point of the carbon rod raises the temperature to the value where evaporation occurs. The evaporated carbon coats the $LaB_6$ rod. The thickness of the coating is 0.1 μm-2 μm.

Step 4. The same as Step 5 in example 1.

Step 5. The fixture 59 is placed on a disk which can be rotated along its own axis in the carbon evaporator. The disk is arranged such that its axis is vertical with respect to the line of sight to the carbon source. Thus evaporated carbon coats each side surface of the square $LaB_6$ rod while the disk is rotating, thereby attaining a uniform coating. Desired thickness is typically, more than 10 μm to provide contact pads to heating conductors.

Step. 6. The same as Step 7 in example 1.

EXAMPLES 3 ($LaB_6$—TaC)

Step. 1. The same as Step 1 in example 1.

Step. 2. The same as Step 2 in example 1.

Step. 3. For carbon coating, the same as Step 3 in example 2.

Step. 4 For tantalum coating, the same as Step 3 in example 1, except that instead of rhenium target material, tantalum target material is used.

Step. 5. A carbon and then tantalum coated cathode undergoes a special heat treatment in order to cause chemical reaction between a thin layer of carbon and another thin layer of tantalum and to thereby produce a thin layer of tantalum carbide. The procedure for the heat treatment is identical to that described in Step 4 of example 1.

Step. 6. The same as Step 5 in example 1.

Step. 7. The same as Step 6 in example 1 except that rhenium used as the target material instead of tantalum.

Step. 8. The same as Step 7 in example 1.

The cathode structure 27 which is coated with a thin layer of carbon needs a very careful control of operating temperature. Otherwise the chemical stability may not be achieved on the top surface 29 of the cathode 27. At a high cathode temperature, thin carbon layer is thermally decomposable owing to carbon loss. The carbon loss may be attributed to its sublimation and its oxidation with $O_2$ in the background gas, thus forming CO and $CO_2$.

In order to prevent the above-mentioned problems another embodiment of the invention for a cathode structure is described here. Now, referring to the FIG, 9, a cathode structure 65 consists of two thin layers 66, 67 of different coating material on a thermoelectron emissive material 55. The thin layer 66 is a reaction barrier layer which prevents chemical reaction between the thermoelectron emissive material 55 and the thin layer 67 of metal which has a high work function, a high melting point and a low vapor pressure. The thermoelectron emissive material 55 is the same as that previously described in detail with reference to FIG. 2. Geometrical parameters which determine optical properties of an electron beam apparatus using the cathode 65 are the same as those for the cathode 27 which were previously described in detail in reference to FIG. 2. The metals of the thin layer 67 having a high work function, a high melting point and a low vapor pressure include rhenium (Re), tantalum (Ta), molybdenum (Mo) and tungsten (W) which are listed in the order of preference based on chemical reaction rates (from slowest to fastest) with $LaB_6$. Although the requirement of no chemical reaction of the thin layer material 67 with the thermoelectron emissive material 55 is removed for the cathode structure 65, it is preferable to use a material having the slowest reaction rate with the thermoelectron emissive material 55, because of the close proximity of the thin layer 67 to the top surface 29. Any material may be used for the thin layer 66 if the material hardly reacts with the thermoelectron emissive material 55 and the metal thin layer 67. Borides, such as tantalum boride ($TaB_6$), titanium boride ($TiB_2$), zirconium boride ($ZrB_2$) or niobium boride ($NbB_2$), carbides such as tantalum carbide (TaC) or zirconium carbide (ZrC), nitrides such as tantalum nitride (TaN) or zirconium nitride and carbon are preferred. The most preferable materials are TaC, $ZrB_2$ and $TiB_2$.

The methods for manufacturing the cathode structure 65 are further illustrated in the following examples.

EXAMPLE 4 ($LaB_6$—$TiB_2$—Re)

Step 1. The same as Step 1 of example 1.
Step 2. The same as Step 2 of example 1.
Step 3. The same as Step 3 of example 1 except that titanium target material is used instead of rhenium target material.
Step 4. Titanium coated $LaB_6$ cathode undergoes a special heat treatment to form titanium boride ($TiB_2$) by a chemical reaction at the interface of the $LaB_6$ cathode and the titanium thin layer. The procedure for the heat treatment is identical to that described in Step 4 of example 1.
Step 5. The same as Step 3 of example 1.
Step 6. The same as Step 5 of example 1.
Step 7. The same as Step 6 of example 1.
Step 8. The same as Step 7 of example 1.

EXAMPLES 5 ($LaB_6$—$ZrB_2$—Re)

All the steps used here are identical to those given in example 4 except that zirconium target material is used instead of the titanium target material in Step 3.

EXAMPLE 6 ($LaB_6$—TaC—Re)

Step 1-through Step 5 here are identical to Step 1 through Step 5 of example 3.
Step 6. The same as Step 3 in example 1.
Step 7. The same as Step 5 in example 1.
Step 8. The same as Step 6 in example 1.
Step 9. The same as Step 7 in example 1.

Although the present invention has been shown and described in what is conceived to be the most practical and preferred embodiments, these may be varied within the scope of this disclosure with similar results. For example, referring to FIG. 1, additional electrode or electrodes can be inserted between the second grid electrode 26 and the anode electrode 32 in order to control the convergence or divergence at the beam at the aperture 31 or to form an image of the electron source somewhere below the aperture 31. Means for heating the cathode 27 can be a direct-heating (i.e. passing heating current) or an indirect heating (i.e. electron bomardment). An efficient heater such as the blocks of graphite can be inserted between the cathode 27 and the heating conductors 23, 23'. The heating wires can be welded on to the cathode 27. Also, referring to FIG. 2 and FIG. 9, profile of a shaped cathode can be spheroidal, hyperbolic or cylindrical with a flat top surface having a finite radius of curvature.

The coating of the thin layers can be done in any coating technology used in Semiconductor Integrated Circuit fabrication processing such as sputtering and ion plating. Furthermore, one end of the rod can be shaped into a non-circular shape, resulting in a non-circular flat top surface for the cathode.

Other modifications, alternatives and equivalents to the embodiments illustrated herein will become apparent to those skilled in the art and, accordingly, the scope of the present invention should be defined only the appended claims and equivalents thereof.

I claim:

1. Electron beam apparatus comprising:

frustum shaped cathode means composed of a thermoelectron emissive material having a low work function and a high operating temperature to provide a high emission current density, said temperature also causing such material to be highly reactive, said cathode means being a single crystal, having a flat single crystal plane top surface and a conical side surface, said flat single crystal plane top surface providing a high saturation emission current density having a uniform angular emission pattern which is essentially normal to said crystal plane and having a uniform intensity distribution at said operating temperature;

a thin coated layer which covers the side surface of said shaped thermoelectron emissive material and whose material has a high work function so as to provide a low saturation emission current density from said side surface relative to said top surface so that side lobes in said beam are prevented even under full exposure to a positive accelerating field, hardly reacts chemically with said thermoelectron emissive material at said operating temperature, has a high melting point, and has a low vapor pressure at said operating temperature; and electrode means for producing an electric field at said top surface for providing an emission region of the Schottky or thermal field type where said top surface is exposed fully to positive accelerating potentials of said electrode means.

2. Electron beam apparatus comprising:

frustum shaped cathode means composed of a thermoelectron emissive material having a low work function and a high operating temperature to provide a high emission current density, said temperature also causing such material to be highly reactive, said cathode means being a single crystal, having a flat single crystal plane top surface and a conical side surface, said flat single crystal plane top surface providing a high saturation emission current density having a uniform angular emission pattern which is essentially normal to said crystal plane and having a uniform intensity distribution at said operating temperature;

a first thin coated layer, which covers the side surface of said shaped thermoelectron emissive material and whose material hardly reacts with said thermoelectron emissive material, has a high melting point and has a low vapor pressure at said operating temperatures;

a second thin coated layer which covers said first thin layer, and whose material has a high work function so as to provide a low saturation emission current density from said side surface relative to said top surface so that side lobes in said beam are prevented even under full exposure to a positive accelerating field, has a high melting point, and has a low vapor pressure at said operating temperature; and electrode means for producing an electric field at said top surface for providing an emission region of the Schottky or thermal field type where said top surface is exposed fully to positive accelerating potentials of said electrode means.

3. An electron beam apparatus as in claim 1 or claim 2, comprising:

triode electrode means having first and second grid electrodes for providing means for extracting an electron beam mostly from used emission current of said top surface having a low energy spread and means for controlling the emission current density from said top surface in the range of one to several hundred times of the saturation emission current density from said top surface at an operating temperature with little variation of electron source size and position;

anode electrode means for providing a ground potential with respect to a high voltage applied at said cathode means which determines the energy of the beam;

means for heating said cathode means to adjust operating temperature at said top surface;

means for adjusting the height of said top surface from the front surface of said first grid electrode and means for locating said cathode means along the axis of said electron beam apparatus;

means for adjusting the spacing between said first grid electrode and said second grid electrode and means for locating said second grid electrode along said axis;

means for adjusting the spacing between said triode means and said anode electrode means and means for locating said triode means along said axis;

spot shaping aperture means positioned along said axis beneath said anode electrode means for shaping electron beam whose cross-section corresponding to said aperture;

beam blanking means located beneath said aperture to deflect said shaped electron beam away from said axis;

deflection means located beneath said anode electrode to direct said shaped beam into another electron beam apparatus which uses the apparatus of the invention;

vacuum isolation valve means for isolating the apparatus of the invention from another electron beam apparatus using the apparatus of the invention, when said another electron beam apparatus is opened to the atmospheric pressure.

4. The apparatus of claim 3 wherein said means for heating said cathode means are provided by heating conductors which hold said cathode means under pressure by clamping screws.

5. The apparatus of claim 3 wherein said means for adjusting the height of said top surface are provided by inserting spacers between the cathode base and said first grid electrode, and said means for locating said cathode means along said axis are provided by four screws which are pushed against said cathode base.

6. The apparatus of claim 3 wherein said means for adjusting said spacing between said first grid electrode and said second grid electrode are provided by spacers inserted between the top surface of the high voltage insulator and said second grid electrode, and said means for locating said second grid electrode along said axis are provided by adjusting a lateral position of said second grid electrode and then screwing it down on the top surface of said high voltage insulator.

7. The apparatus of claim 3 wherein said means for adjusting the spacing between said triode electrode means and said anode electrode means are provided by inserting spacers between the shoulder of the insulator support tube and the X-Y adjuster, and said means for locating said triode electrode means along said axis are provided by four screws which push said X-Y adjuster.

8. The apparatus of claim 3 wherein said spot shaping aperture has a rectangular shape.

9. The apparatus of claim 3 wherein said beam blanking means comprise at least one pair of plates spaced from and facing each other in a lateral direction across said axis, and means for applying a voltage between said plates.

10. The apparatus of claim 3 wherein said deflection means are electromagnetic deflection means positioned beneath said anode electrode.

11. The apparatus of claim 10 wherein said electromagnetic deflection means consist of two pairs of deflection yokes, one pair being spaced from the other in a direction along said axis, and means for providing currents in each of four deflection yokes to shift said shaped beam in a lateral direction across said axis.

12. The apparatus of claim 1, or claim 2 wherein said thermoelectron emissive material has a general formula of $MB_6$ wherein M represents alkali earth metal or rare earth metal.

13. Said thermoelectron emissive material claimed in claim 12 wherein the alkali earth metal is selected from group consisting of barium (Ba) and calcium (Ca).

14. Said alkali earth metal claimed in claim 13, wherein the alkali earth metal is barium.

15. Said thermoelectron emissive material claimed in claim 12 wherein the rare earth metal is selected from the group consisting of lanthanum (La) neodymium (Nd) praseodymium (Pr) gadolinium (Gd), yttrium (Y) and samarium (Sm).

16. Said rare earth metal claimed in claim 15 wherein the rare earth metal is lanthanum.

17. The apparatus of claim 1 or claim 2 wherein said thermoelectron emissive material has a general formula $M_xN_{x-1}B_6$ wherein both M and N represent rare earth material and X varies from zero to one.

18. Said thermoelectron emissive material claimed in claim 17 wherein M and N represent lanthanum and neodymium respectively and $X=0.3$.

19. Said thermoelectron emissive material claimed in claim 17 wherein M and N represent lanthanum and praseodymium respectively and $X=0.3$.

20. The apparatus of claim 1 or claim 2 wherein said thermoelectron emissive material includes combinations of rare earth metal borides.

21. Said combinations of rare earth metal borides claimed in claim 20 include compounds of praseodymium with 10%-30% additions of lanthanum hexaboride.

22. Said combinations of rare earth metal borides claimed in claim 20 include compounds of neodymium hexaboride with 10%-30% additions of lanthanum hexaboride.

23. The apparatus of claim 1 wherein the material of said thin layer is selected from rhenium and tantalum carbide.

24. The apparatus of claim 2 wherein the material of said first thin layer is selected from one or more of groups consisting of zirconium boride ($ZrB_2$), titanium boride ($TiB_2$), tantalum carbide (TaC) and carbon (C).

25. The apparatus of claim 2 wherein the material of said second thin layer is selected from the group consisting of tantalum, tungsten, molybedenum, and rhenium.

26. A method of manufacturing the apparatus of claim 1 which comprises steps of cutting a rod from a thermoelectron emissive material having a low work function, shaping one end of the rod into a cone, spheroid or hyperbola, coating the rod with a material which has a high work function, a high melting point, a low vapor pressure at an operating temperature and hardly reacts chemically with said thermoelectron emissive material at said operating temperature, a heat treatment for speeding up any possible chemical reaction at the interface between said two materials at a temperature higher than normal cathode operating temperature, coating the rod below the cone base of said shaped end of the rod with a thick layer of a material which has a high melting point, a low vapor pressure at said operating temperature and hardly reacts chemically with said thermoelectron emissive material at said operating temperature, in order to provide contact pads for heating conductors, and lapping and polishing top portion of said shaped end of the rod.

27. A method of manufacturing the apparatus of claim 2 which comprises steps of cutting a rod from a thermoelectron emissive material having a low work function, shaping one end of the rod into a cone, spheroid or hyperbola, coating the rod, for a first layer, with a material which has a high melting point, a low vapor pressure and hardly reacts chemically with said thermoelectron emissive material as well as a second layer at said operating temperature, coating the rod, for a second layer, with a material which has a high work function, a high melting point and a low vapor pressure at said operating temperature, and lapping and polishing top portion of said shaped end of the rod.

28. The methods as claimed in claim 26 or claim 27 wherein the rod is cut out by means of ultrasonic cutting, electron discharging cutting or diamond cutting.

29. The method as claimed in claim 26 wherein the heat treatment is to speed up any possible chemical reaction at the interface between said two materials and possible diffusion of the coating material into the thermoelectron emissive material at a temperature about from 100° C. to 700° C. higher than a cathode operating temperature by intense electron beam bombardment for approximately a half hour to an hour in an electron beam evaporator.

30. The apparatus of claim 3 further including said triode electrode means for providing a very large differential ratio of emission current from the top surface of the cathode means to that from the rest of the surface of said cathode means at an operating temperature, means for producing the used emission current having a uniform intensity distribution, means for providing a low energy spread in said used emission current and minimizing space-charge effect, and means for controlling an emission current density from said top surface in the range of one to several hundred times of the saturation emission current density at said operating temperature with little variation of electron source size and position, comprising:

said cathode means comprising a shaped thermoelectron emissive material having a flat top surface and a thin layer which covers the side surface of said shaped thermoelectron emissive material and whose material has a high work function;

the first grid electrode means on which a voltage applied restricts an electron emission area on said side surface of said cathode means at said operating temperatures;

the second grid electrode means on which an adjustable voltage applied varies a strength of accelerating electric field at said top surface.

31. The apparatus of claim 30 wherein said means for providing said very large differential ratio of emission current from said top surface to that from said side surface of said cathode means are provided both by using said cathode means which provide a very large differential ratio of the saturation emission current density from said top surface to that from said side surface at an operating temperature and by restricting an electron emission area on said side surface by a voltage applied on said first electrode means.

32. The apparatus of claim 30 wherein said means for producing the used emission current having a uniform intensity distribution are provided by using said cathode whose top surface is a single crystal thermoelectron emissive material which has a uniform angular emission pattern and a uniform intensity distribution.

33. The apparatus of claim 30 wherein said means for providing a low energy spread in said used emission current and minimizing the space charge effect are provided by using said cathode means whose top surface is immersed in an accelerating field provided by a voltage applied on said second electrode means.

34. The apparatus of claim 30 wherein said means for controlling emission current density in the range of one to several hundred times of the saturation emission current density are provided by adjusting the strength of electric field from $10^3$ V/cm to $10^7$ V/cm at said top surface by varying a voltage applied on said second electrode means.

35. The apparatus of claim 30 wherein said means for providing said very large differential ratio of emission current from said top surface to that from said side surface are provided both by placing said top surface as close as possible to the same height as the front surface of said first grid electrode and by restricting an electron emission area on said side surface by a voltage applied on said first electrode means.

36. The apparatus of claim 1 wherein the the material of said thin layer is chemically non-reactive with said thermoelectron emissive material, which is selected from one or more of groups consisting of borides, such as tantalum boride ($TaB_6$), titanium boride ($TiB_2$), zirconium boride ($ZrB_2$) or niobium boride ($NbB_2$), carbides such as tantalum carbide (TaC) or zirconium carbide (ZrC), and nitrides such as tantalum nitride (TaN) or zirconium nitride.

37. The apparatus of claim 2 wherein the material of said first thin layer is chemically non-reactive with said thermoelectron emissive material, which is selected from one or more of groups consisting of borides, such as tantalum boride ($TaB_6$), titanium boride ($TiB_2$), zirconium boride ($ZrB_2$) or niobium boride ($NbB_2$), carbides such as tantalum carbide (TaC) or zirconium carbide (ZrC), and nitrides such as tantalum nitride (TaN) or zirconium nitride.

38. The apparatus of claim 1 wherein the material of said thin layer is carbon.

39. The apparatus of claim 2 wherein the material of said second thin layer is carbon.

* * * * *

UNITED STATES PATENT AND TRADEMARK OFFICE

CERTIFICATE OF CORRECTION

PATENT NO. : 4,528,474

DATED : July 9, 1985

INVENTOR(S) : Jason J. Kim

It is certified that error appears in the above-identified patent and that said Letters Patent is hereby corrected as shown below:

Column 1, line 47, delete "$J \simeq J_o(eV/\Delta E_t)\sin^{2\alpha}$" and substitute --$J \simeq J_o(eV/\Delta E_t)\sin^2\alpha$--.

Column 1, line 66, delete "electronelectron" and substitute --electron-electron--.

Column 3, line 53, delete "thermalfield" and substitute --thermal field--.

Column 6, line 33, delete "a work function" and substitute "a high work function--.

Column 6, line 49, delete "$e-\phi/kT$" and substitute --$e^{-\phi/kT}$--.

Column 7, line 24, delete "$e^{0.44VE/T}$" and substitute --$e^{0.44\sqrt{E}/T}$--.

UNITED STATES PATENT AND TRADEMARK OFFICE

CERTIFICATE OF CORRECTION

PATENT NO. : 4,528,474

DATED : July 9, 1985

INVENTOR(S) : Jason J. Kim

It is certified that error appears in the above-identified patent and that said Letters Patent is hereby corrected as shown below:

Column 7, line 44, delete "thermalfield" and substitute --thermal field--.

Column 8, line 4, delete "thermalfield" and substitute --thermal field--.

Signed and Sealed this

*Twenty-sixth* Day of *November 1985*

[SEAL]

*Attest:*

DONALD J. QUIGG

*Attesting Officer*

*Commissioner of Patents and Trademarks*